United States Patent [19]

Itaya et al.

[11] Patent Number: 4,530,597

[45] Date of Patent: Jul. 23, 1985

[54] BRUSH CLEANING DEVICE

[75] Inventors: Masahiko Itaya; Satoshi Haneda, both of Hachioji, Japan

[73] Assignee: Konishiroku Photo Industry Co., Ltd., Tokyo, Japan

[21] Appl. No.: 465,422

[22] Filed: Feb. 9, 1983

[30] Foreign Application Priority Data

| | | | |
|---|---|---|---|
| Feb. 15, 1982 | [JP] | Japan | 57-23200 |
| Feb. 15, 1982 | [JP] | Japan | 57-18563[U] |
| Feb. 15, 1982 | [JP] | Japan | 57-20333[U] |

[51] Int. Cl.[3] ..... G03G 21/00

[52] U.S. Cl. ..... 355/15; 15/256.52; 118/652

[58] Field of Search ..... 355/15, 3 R; 15/256.51, 15/256.52, 1.5; 118/652

[56] References Cited

U.S. PATENT DOCUMENTS

| | | | |
|---|---|---|---|
| 4,097,140 | 6/1978 | Suzuki et al. | 355/15 |
| 4,263,390 | 4/1981 | Yamashita et al. | 15/256.52 X |

FOREIGN PATENT DOCUMENTS

| | | | |
|---|---|---|---|
| 157771 | 12/1980 | Japan | 355/15 |
| 113185 | 9/1981 | Japan | 355/15 |
| 135873 | 10/1981 | Japan | 355/15 |
| 149078 | 11/1981 | Japan | 355/15 |
| 062079 | 4/1982 | Japan | 355/15 |

*Primary Examiner*—Richard L. Moses

*Attorney, Agent, or Firm*—Jordan B. Bierman

[57] ABSTRACT

A brush cleaning device for electrophotographic reproducing apparatus of the type wherein a fur brush is contacted against an image receptor for removing magnetic toner remaining thereon, comprises a nonmagnetic cylindrical sleeve disposed near the fur brush, and a magnetic member disposed inside the cylindrical sleeve to attract the toner onto the surface of the sleeve. At least one of the cylindrical sleeve and the magnetic member is made to rotate, and the cylindrical sleeve is formed with a spiral projection on its surface. A flicker member for dispersing magnetic toner removed from the image receptor onto the cylindrical sleeve is provided. A cleaning member is arranged at the downstream end portion of the cylindrical sleeve for cleaning magnetic toner carried on the cylindrical sleeve by the spiral projection.

14 Claims, 9 Drawing Figures

PRIOR ART FIG. 1
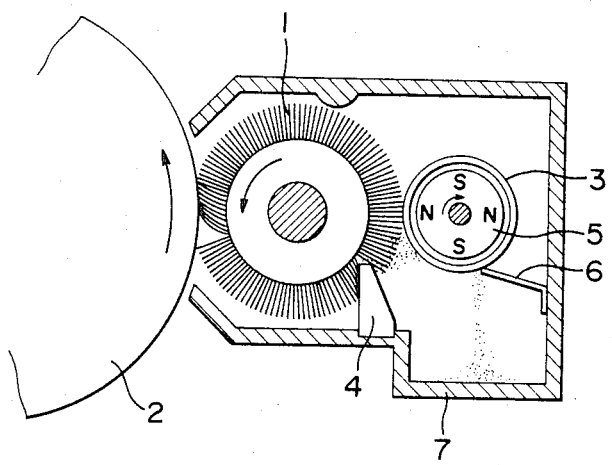
FIG. 2
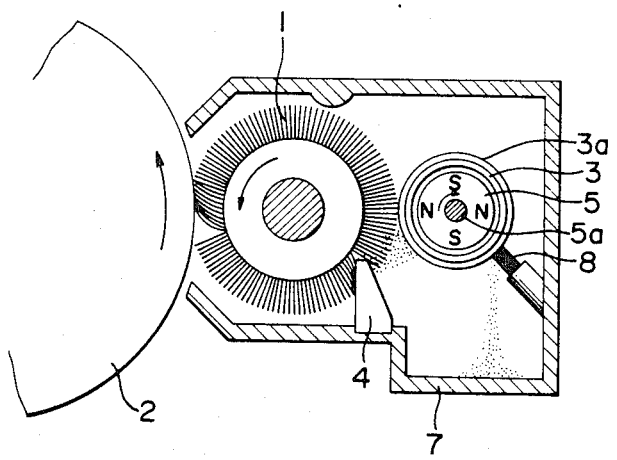

BRUSH CLEANING DEVICE

BACKGROUND OF THE INVENTION

1. Field of the Invention

The present invention relates to a brush cleaning device for electrophotographic reproducing apparatus and more particularly to a brush cleaning device in which magnetic toner powder remaining on the image receptor after the image transfer process is removed from the image receptor by a fur brush.

2. Description of the Prior Art

In a general brush cleaning device used with electrophotographic reproducing apparatus, the rotation of a fur brush sends magnetic toner powder flying in the space within the apparatus. To recover the toner powder into a filter, a blower is incorporated in the apparatus making it large in size and noisy during operation.

To solve this problem, a device such as shown in FIG. 1 has been proposed. In this device, a non-magnetic cylindrical sleeve 3 is placed near the fur brush 1 which brushes off magnetic toner from the image receptor 2; a magnetic member 5 is placed inside the cylindrical sleeve 3 to attract the magnetic toner released from the fur brush by a flicker member 4 onto the external surface of the sleeve 3; and the magnetic toner on the cylindrical sleeve 3 is scraped off by a scraper 6 and recovered. This type of brush cleaning device has little toner powder flying in the device and thus does not require a blower, which in turn enables reduction in the size of the device and results in little fatigue of the magnetic toner. Despite these features, the proposed device has the following drawbacks in recovering the magnetic toner for reuse. The first problem is that broken hair of the fur brush 1 mixes with the recovered toner, which will cause problems. The second problem is that a device such as a magnetic toner discharging screw must be provided where the magnetic toner is to be collected, and this increases the number of parts and makes difficult the size reduction of the device.

As a means for carrying powder, a device such as a screw conveyor is known which is formed of a combination of a cylindrical tube and a coil which carries powder by rotation of the coil. In such devices the powder near the bottom of the tube is acted upon by a strong force due to gravity and may be hardened or impaired. Further, the powder carrier path is limited almost to a linear path and no large abrupt change in height is allowed for the path. The screw conveyor could not be relied upon to move a constant amount of powder.

SUMMARY OF THE INVENTION

An object of this invention is to provide a brush cleaning device which has a spiral projection formed on the external surface of the cylindrical sleeve so as to prevent mixing of broken fur into the recovered toner, realize a reduction in the size of the device, prevent the flying or dispersing of magnetic toner, enable easy recovery and reduce fatigue of the magnetic toner.

Another object of this invention is to provide a brush cleaning device for electrophotographic reproducing apparatus which comprises: a fur brush to brush off magnetic toner powder remaining on the image receptor after the image transfer process; a magnetic toner attracting bar placed close to the fur brush to attract the magnetic toner onto its external surface; and a spiral member with its inner surface in sliding engagement with the external surface of the toner attracting bar; whereby at least one of the toner attracting bar and the spiral member is made to rotate, so as to prevent the mixing of broken fur into the recovered magnetic toner, realize reduction in the size of the device, prevent dispersing of magnetic toner, realize easy recovery of used toner and reduce fatigue of the toner.

Still another object of this invention is to provide a magnetic powder carrying device which overcomes the conventional drawbacks by utilizing the characteristic of the magnetic powder, i.e., by providing a coil wound around the cylindrical or circular column magnet to give a relative rotation between the magnet and the coil.

Other objects and features of this invention will become apparent in the following detailed description with reference to the attached drawings.

BRIEF DESCRIPTION OF THE DRAWINGS

FIG. 1 is an explanatory view showing the structure of the conventional device;

FIG. 2 is an explanatory view showing the structure of one embodiment of this invention;

DESCRIPTION OF THE PREFERRED EMBODIMENTS

FIG. 2 is an explanatory view showing a cleaning device embodying the present invention. The members alike to those shown in FIG. 1 carry like reference numbers.

Figure 3:
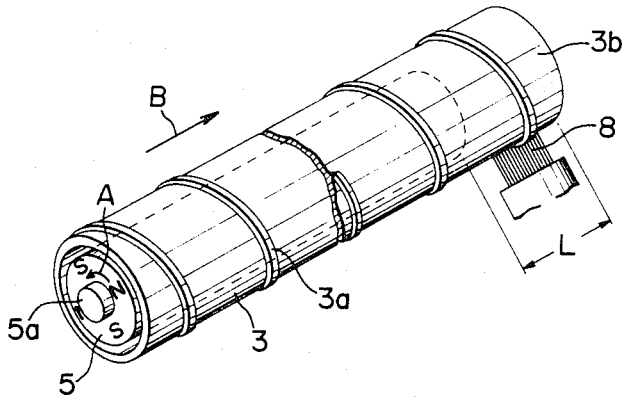
FIG. 3 is a perspective view showing a part of the device shown in FIG. 2.

In this invention, as shown in FIG. 3, the nonmagnetic cylindrical sleeve 3 disposed close to the fur brush 1 has a spiral projection **3*a* formed on its external surface from one end of the sleeve to the other. Both ends of the cylindrical sleeve 3 are secured to the cleaning box 7. Designated 5*a* is a shaft of the magnetic member 5 which rotates in the direction indicated by the arrow A and which, as shown in FIG. 3, is formed with N and S poles alternately along the circumference. The length of the magnetic member 5 is set shorter than the cylindrical sleeve 3 so that the magnetic field at the end 3*b* (segment L) of the sleeve 3 where the toner is collected is small in intensity. The magnetic member 5 and the cylindrical sleeve 3 are constructed so that they rotate relative to each other. In this embodiment the cylindrical sleeve 3 is fixed while the magnetic member 5 is rotated. This is because the cylindrical sleeve 3 can be used as a stay for the cleaning box 7 and the structure becomes simple. Denoted 8 is a brush placed in contact with the peripheral surface at the end 3*b* of the sleeve 3 to remove magnetic toner from it. The brush is rigidly fixed to the cleaning box 7**.

Now, the operation of the device with the above construction is explained in the following.

Figure 4:
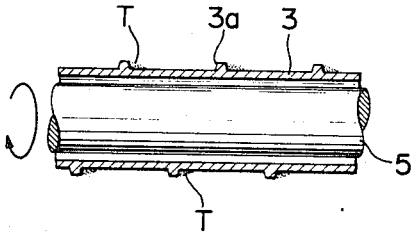
FIG. 4 is a cross-sectional view of a cylindrical sleeve.

The magnetic toner remaining on the image receptor 2 rotating in the direction of the arrow in FIG. 2 is brushed off from the image receptor 2 and carried by the rotating fur brush 1. When the rotating fur brush 1 reaches the position of the flicker member 4, the brush 1 is agitated by the flicker member 4 to release the toner near the cylindrical sleeve 3. At this time the magnetic member 5 attracts the flying magnetic toner to the outer surface of the sleeve 3 and causes the toner attaching on the sleeve 3 to slide or roll on the circumferential sleeve surface in synchronism with the rotation of the magnetic member 5. Since the cylindrical sleeve 3 is formed with a spiral projection 3*a* on the outer surface, the magnetic toner made to slide along the circumferential surface is driven by the spiral projection 3*a* in the axial direction B (see FIG. 4 where T denotes the magnetic toner). The toner is then thrust along the spiral path to be carried over to the end 3*b* of the sleeve 3 where it is brushed off from the circumferential surface of the sleeve 3 by the brush 8 which is placed in contact with the circumferential surface. The toner thus brushed off falls and accumulates at the bottom of the cleaning box 7.

In the brush cleaning device with the above construction, if hair of the fur brush should be broken and become mixed with the magnetic toner, the broken hair, as well as dust and paper lint, which are all nonmagnetic, will fall from the cylindrical sleeve 3 and therefore will not be carried over to where the used toner is collected. Therefore no trouble will occur when the recovered toner is used again. Since the brush 8 is held immovable, there is little possibility of the hair of the brush being broken. Especially in this embodiment in which the cylindrical sleeve 3 is also held immovable, there can be almost no such possibility. If a scraper plate is used instead of the brush 8, such possibility does not exist.

Furthermore, with this brush cleaning device, the cylindrical sleeve 3 functions as the toner discharging screw, and the equipment can be made more compact. In addition, since the fallen toner accumulates below the brush 8 within a small area, the used toner can be recovered with ease. Moreover, since the toner is brushed off where the magnetic field is weak, no excess force is applied to the toner thus reducing the fatigue of the toner.

These features were confirmed with an experiment using the cleaning device in which the outer diameter of the cylindrical sleeve 3 was set at 25 mm (including the spiral projection 3*a*); the height of projection 3*a* was set at 1 mm; the distance between the end of the fur brush 1 and the end of the cylindrical sleeve 3 was set at 1 mm; the outer diameter of the magnetic member 5 was set at 20 mm; the rotating speed of the magnetic member 5 was set at 300 rpm; the number of magnetic poles used was 4 (1000 gauss); the outer diameter of the fur brush 1 was set at 32 mm; the length of the fur brush hair was set at 6 mm; Teflon (Trade Mark of polytetrafluoroethylene) was chosen for the material; and the rotating speed of the fur brush was set at 300 rpm.

Figure 5:
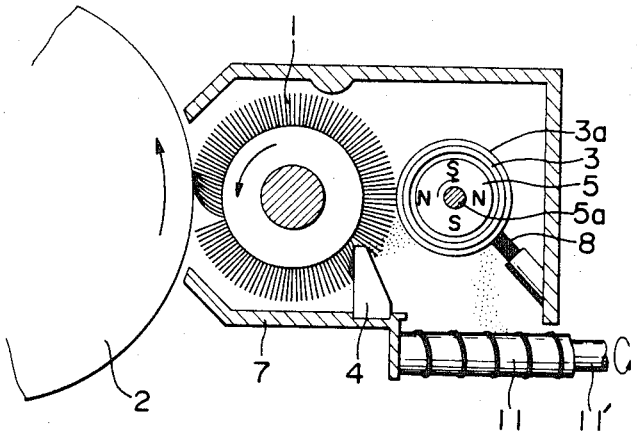
FIG. 5 is an explanatory view showing the structure of another embodiment of this invention.

FIG. 5 shows another embodiment of this invention. Members alike to those shown in FIG. 2 carry like reference numbers. Beneath the end 3*b* of the cylindrical sleeve 3 of FIG. 2, a carrier consisting of a cylindrical sleeve 11 and a magnetic member 11′ is provided to send the magnetic toner toward the developing equipment so as to make possible the repetitive use of the toner. The structures of the cylindrical sleeve 11 and the magnetic member 11′ are totally identical to those of cylindrical sleeve 3 and the magnetic member 5.

As can be seen from the above, with this invention it is possible to prevent mixing of broken hairs of the fur brush into the recovered magnetic toner, realize reduction in the size of the device, prevent the toner from flying or dispersing, enable easy and smooth recovery of toner and reduce fatigue of the toner.

Figure 6:
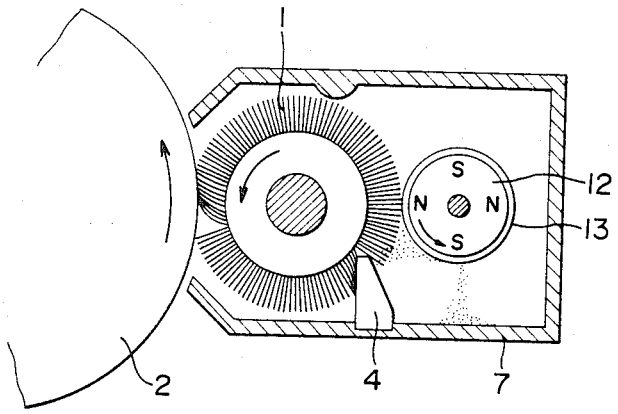
FIG. 6 is an explanatory view showing the structure of still another embodiment of this invention.
Figure 7:
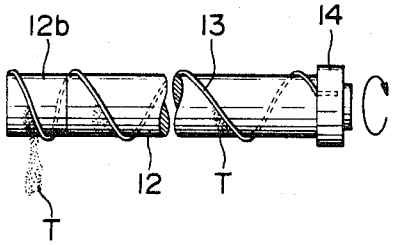
FIG. 7 is an explanatory view showing a part of the device shown in FIG. 6.

FIG. 6 shows still another embodiment of this invention in which members alike to those shown in FIG. 2 carry like reference numbers. Denoted 12 is a magnetic toner attracting bar or member which is located near the fur brush 1 and which rotates in the direction of arrow and has magnetic poles N and S formed alternately along the circumference, as shown in FIG. 6. The end 12*b* (see FIG. 7) of the bar 12 to which the toner is carried is formed of nonmagnetic material. A spiral member or coil 13, as shown in FIG. 7, is sleeved over and in sliding contact with the toner attracting bar 12 with each end of the spiral member 13 mounted to the cleaning box 7 through the support member 14. The spiral member 13 and the magnetic toner attracting bar 12 need only rotate relative to each other. In this embodiment the toner attracting bar 12 is rotated while the spiral member 13 is rigidly fixed.

Next, the operation of the device with the above structure is explained.

The magnetic toner remaining on the image receptor 2 rotating in the direction of the arrow of FIG. 6 is brushed off from the image receptor 2 and carried by the rotating fur brush 1. When the rotating fur brush 1 reaches the position of the flicker member 4, the toner is agitated by the flicker member 4 to release the toner which flies near the magnetic toner attracting bar 12. The flying magnetic toner is attracted to the rotating toner attracting bar 12 becoming attached onto its surface. Since the spiral member 13 is sleeved over and in sliding contact with the surface of the bar 12, the toner attaching to the bar 12 is driven by the spiral member 13 in the axial direction (see FIG. 7) and carried over to the end 12*b* of the bar 12. The end 12*b* of the bar 12 is formed of nonmagnetic material, so that the magnetic toner carried over there falls accumulating at the bottom of the cleaning box just below the bar end 12*b*.

In the brush cleaning device of the above construction, any broken hair of brush 1 will fall from the toner attracting bar 12 since the brush hair is nonmagnetic and therefore can be prevented from being carried over to where the magnetic toner is collected. This means no trouble will occur when the recovered toner is used again. Another advantage of this embodiment is that since magnetic toner attracting bar 12 and the spiral member 13 have the same function of the toner discharging screw, the device can be made compact. Further, since the falling toner collects in the area just below the end 12*b* of the toner attracting bar 12, it can easily be recovered. Moreover, since the toner is allowed to fall from the bar 12 without being acted upon by force, the fatigue of the toner can be minimized.

The above features and effects have been confirmed with an experiment using the device in which a piano wire of 1 mm diameter is wound at a 20 mm pitch to form the spiral member 13; the gap between the fur brush 1 and the spiral member 13 is set at 1 mm; the outer diameter of the toner attracting bar 12 is set at 20 mm; the rotating speed of the bar is set at 100 rpm; the number of magnetic poles is set at four (1000 gauss); and the outer diameter of the fur brush is set at 32 mm, the brush hair length at 6 mm, and the rotating speed at 300 rpm with Teflon used as the material.

Figure 8:
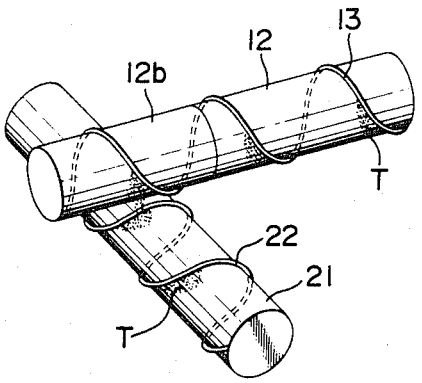
FIG. 8 is an explanatory view showing the structure of further embodiment of this invention.

FIG. 8 shows a part of further embodiment of this invention. Members alike to those shown in FIG. 7 carry like reference numbers. In this embodiment, a toner carrier means consisting of a toner attracting bar 21 and a spiral member 22 is provided below the end 12*b* of the toner attracting bar 12 of FIG. 7 so as to cross under the bar 12. The toner carrier means sends the toner to the development device for reuse of the recovered toner. The structures of the toner attracting bar 21 and the spiral member 22 are identical to those of the toner attracting bar 12 and the spiral member 13.

As can be seen from the foregoing, with the present invention it is possible to prevent the mixing of broken fur brush hairs into the recovered toner and realize the size reduction of the device as well as prevent the toner from flying, assure easy recovery to toner and reduce fatigue of toner.

Figure 9:
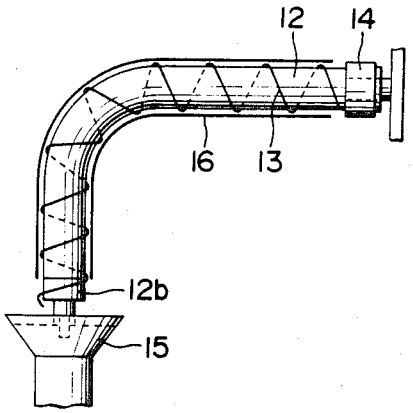
FIG. 9 is an explanatory view showing the carrier path of this invention.

The magnetic member 11′ or magnetic toner attracting member 12 may be bent as shown in FIG. 9. In this case it is preferable that the toner attracting member 12 be held immovable and the coil 13 be rotated. But it is also possible to form the toner attracting member 12 from a rubber magnet, and to hold the coil 13 immovable while the toner attracting member 12 is rotated. This is exemplified by FIG. 9 in which the nonmagnetic end portion 12*b* of the toner attracting member 12 is rotatably supported at the entrance of the magnetic powder receiving hopper 15. For the device with a bent carrier path it is preferable to provide an external cylinder 16.

What is claimed is:

1. A brush cleaning device for electrophotographic reproducing apparatus, comprising: a fur brush for removing magnetic toner remaining on an image receptor after the image transfer process; a nonmagnetic cylindrical sleeve disposed near the fur brush; a magnetic member disposed inside the cylindrical sleeve to attract the toner onto the surface of the sleeve, whereby at least one of the cylindrical sleeve and the magnetic member is made to rotate; and a spiral projection formed on the surface of the sleeve for moving in an axial direction of the sleeve the magnetic toner slidingly or rotatably thereon by the rotation of said cylindrical sleeve or magnetic member.

2. A brush cleaning device as defined in claim 1, wherein the magnetic field is made small at the end of the cylindrical sleeve where the toner carried over is removed from the sleeve.

3. A brush cleaning device as defined in claim 1, further comprising a flick member for dispensing magnetic toner removed from the image receptor to the cylindrical sleeve.

4. A brush cleaning device as defined in claim 1, further comprising a cleaning member arranged at the downstream end portion of the cylindrical sleeve for cleaning magnetic toner carried on the cylindrical sleeve by the spiral projection of the cylindrical sleeve therefrom.

5. A brush cleaning device as defined in claim 4, wherein said cleaning member is formed of a fur brush.

6. A brush cleaning device as defined in claim 4, further comprising a flick member for dispensing magnetic toner removed from the image receptor to the cylindrical sleeve.

7. A brush cleaning device for electrophotographic reproducing apparatus, comprising: a fur brush for removing magnetic toner remaining on an image receptor after the image transfer process; a magnetic toner attracting member disposed near the fur brush for attracting the toner onto its surface; and a spiral member sleeved over and placed in sliding contact with the toner attracting member for moving the toner in an axial direction slidingly or rotatably over the surface of the toner attracting member, at least one of the toner attracting member and the spiral member being made to rotate relative to the other.

8. A brush cleaning device as defined in claim 7, wherein the end of the magnetic toner attracting member where the toner is carried over is formed of a nonmagnetic material.

9. A brush cleaning device as defined in claim 7, further comprising a flick member, positioned between the image receptor and the toner attracting member, for dispensing magnetic toner removed from the image receptor to the cylindrical sleeve.

10. A brush cleaning device as defined in claim 7, further comprising a cleaning member arranged at the downstream end portion of the magnetic toner attracting member for cleaning magnetic toner carried by the attracting member and the spiral member therefrom.

11. A brush cleaning device as defined in claim 10, wherein said cleaning member is formed of a fur brush.

12. A brush cleaning device as defined in claim 10, further comprising a flick member, positioned between the image receptor and the toner attracting member, for dispensing magnetic toner removed from the image receptor to the toner attracting member.

13. A magnetic particle carrier device comprising: a cylindrical or circular column magnet and a coil wound around the magnet so that there is a relative rotation between them.

14. A magnetic particle carrier device as defined in claim 13, wherein the magnet is formed of a flexible magnet such as a rubber magnet.

* * * * *